United States Patent [19]

Blanchard et al.

[11] 4,311,889

[45] Jan. 19, 1982

[54] ALARM DEVICE

[76] Inventors: Jeffrey R. Blanchard, 1267 Clarence St., St. Paul, Minn. 55106; Lawrence J. Themmes, 2656 E. 16th Ave., North, St. Paul, Minn. 55109

[21] Appl. No.: 116,096

[22] Filed: Jan. 28, 1980

[51] Int. Cl.[3] ..... H01H 35/00

[52] U.S. Cl. ..... 200/52 R; 200/61.93; 200/86 R; 340/565

[58] Field of Search ..... 200/52 R, 61.41, 61.42, 200/61.44, 61.93, 85, 86, 86.5, 237–239, 249, 251, 288, 275, 276; 340/507, 541, 550, 573, 666, 686

[56] References Cited

U.S. PATENT DOCUMENTS

| | | | |
|---|---|---|---|
| 732,813 | 7/1903 | Arnold | 340/507 |
| 940,535 | 11/1909 | Korbel | 200/85 R |
| 1,034,223 | 7/1912 | Erickson | 200/86 R |
| 1,101,999 | 6/1914 | Clark | 260/85 R |
| 1,660,070 | 2/1928 | Crane | 200/86 R |
| 1,928,472 | 9/1933 | Wilcox | 200/86 R |
| 2,173,089 | 9/1939 | Geer | 200/86 R |
| 2,243,911 | 6/1941 | Lakatos | 200/275 X |
| 2,547,214 | 4/1951 | Jones et al. | 200/61.41 |
| 2,551,754 | 5/1951 | Meredith | 200/85 R |
| 2,683,784 | 7/1954 | Rector | 200/86 R |
| 2,761,038 | 8/1956 | Bruns | 200/86 R |
| 2,779,583 | 1/1957 | Bine | 246/251 |
| 2,794,089 | 5/1957 | Hogg et al. | 200/85 R |
| 3,207,870 | 9/1965 | Herrera et al. | 200/61.41 |
| 3,588,416 | 6/1971 | Millam | 200/85 R |
| 3,596,024 | 7/1971 | Smith | 200/86 R |

*Primary Examiner*—James R. Scott

[57] ABSTRACT

An alarm device including an alarm switch mounted on the structure of a building that carries walking surfaces such as a floor joist. A switch is actuated upon structural deflection associated with imposition of predetermined amount of weight at the area of the switch as when a person is walking thereon. The deflection of the structure causes relative movement between an electrical contact and an electrically conductive taut wire to energize a circuit which can give an alarm or other indication.

19 Claims, 6 Drawing Figures

Fig. 1
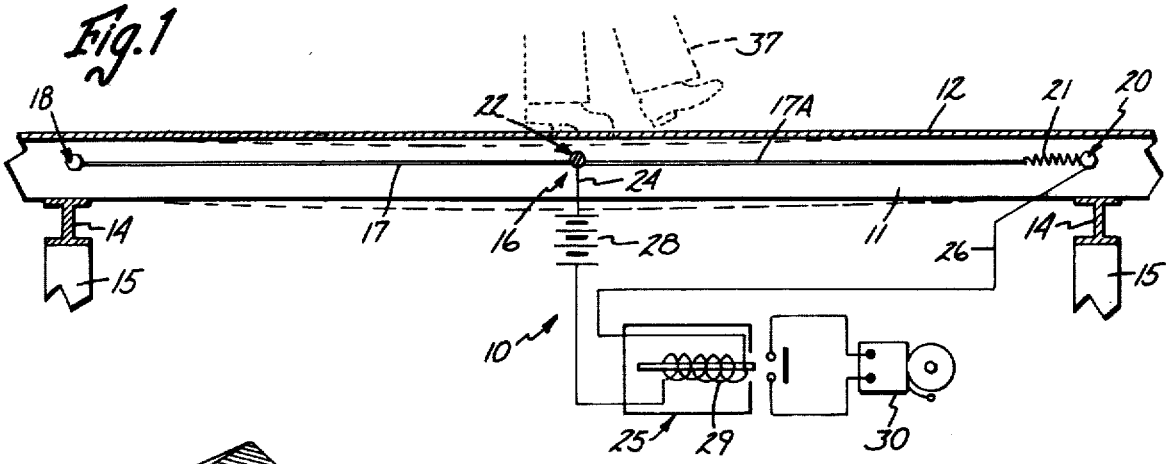
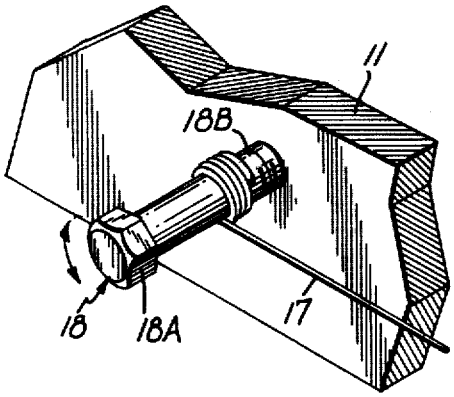
Fig. 2
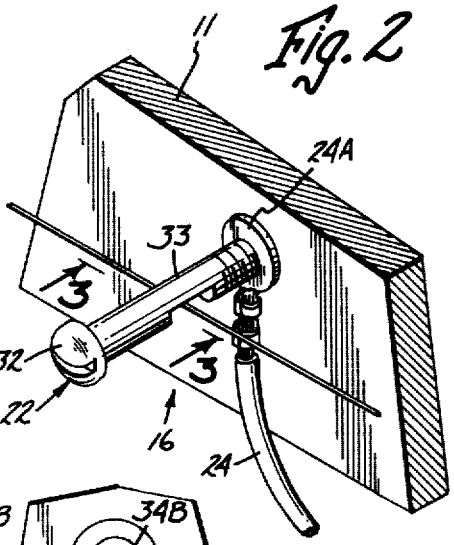
Fig. 3
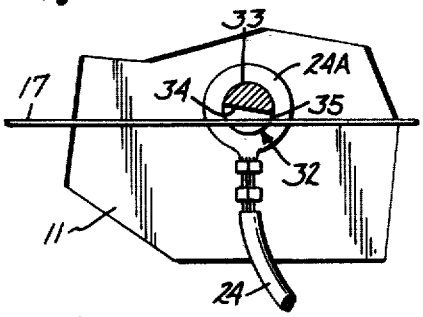
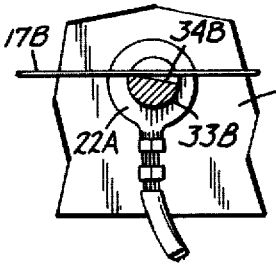
Fig. 4
Fig. 5
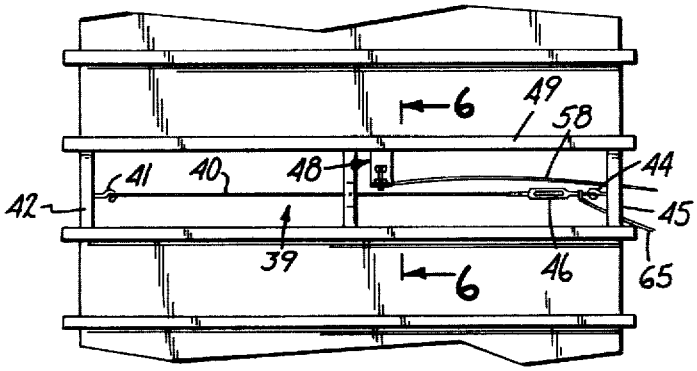
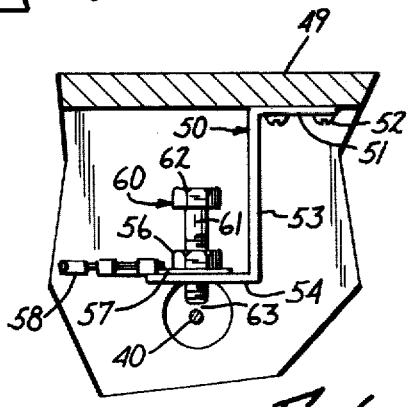
Fig. 6

ALARM DEVICE

BACKGROUND OF THE INVENTION

The invention pertains to the field of burglar alarms or overload indicators. Burglar alarms of current usage employ pressure plates, photo electric sensors, ultrasonic sensors and like devices that can be complicated and expensive.

The present invention provides an alarm device including an alarm switch mounted with respect to a structural component of a building, such as a floor joist, so as to sense deflection of the component as occasioned by the weight of an unwanted intruder walking in the vicinity of the alarm switch.

The alarm device includes a taut horizontal electrically conductive wire strung between two anchoring members on a building component that will deflect when walked upon such as a floor joist or a stair step. An electrical contact is fastened to the building component in close relationship to the wire. When weight is placed above the device by a person walking overhead, there is a deflection of the building component and corresponding deflection of the electrical contact. The wire remains stationary. The deflection occasioned by the weight above the device causes the electrical contact either to come in contact with the wire or to move out of contact with the wire, in either case causing an alarm circuit to be energized.

The alarm device is inexpensive and simple to install and effective in use.

IN THE DRAWINGS

FIG. 1 is an elevational view of an alarm device according to the invention installed with respect to a building.

FIG. 2 is an enlarged fragmented perspective view of a portion of the alarm device of FIG. 1;

FIG. 3 is a sectional view of a portion of the alarm device shown in FIG. 2 taken along the line 3—3 thereof;

FIG. 4 is a view like that of FIG. 3 but showing the electrical contact in the modified orientation;

FIG. 5 is a plan view of an alarm device according to another form of the invention installed with respect to a building;

FIG. 6 is an enlarged sectional view of the alarm device of FIG. 5 taken along the line 6—6 thereof.

DESCRIPTION OF PREFERRED EMBODIMENTS

Referring to the drawings, there is shown in FIG. 1 an alarm system indicated generally at 10 installed with respect to a wooden floor joist 11 located in a building such as a house and supporting a wooden floor 12. Joist 11 is one of many such joists in the building and is supported by horizontal I-beams 14 which in turn are supported by vertical standards 15 with respect to a lower floor or other supporting surface.

Alarm system 10 includes an alarm device or switch 16 mounted on joist 11 and comprised as an elongated length of electrically conductive wire 17 such as piano wire mounted horizontally parallel to joist 11 between a first anchor 18 and a second anchor 20. Anchors 18 and 20 are securely fastened into the joist 11. A tension spring 21 is disposed between the second anchor 20 and the end of wire 17.

As shown in FIG. 2, the first anchor 18 is comprised as a lag screw having a head 18A for engagement by a wrench, and a threaded shank 18B. The end of wire 17 is connected to a shank 18B of anchor 18 as by being fixed in a hole provided therein. Rotation of anchor 18 in a direction to thread the shank 18B into the joist 11 is effective to tighten or increase the tension of the wire 17. The spring 21 maintains the wire taut between the first and second anchors 18, 20.

Intermediate between the first and second anchors 18, 20, and proximate the wire 17 is an electrical contact 22 fixed to joist 11. A first electrical lead 24 extends from the electrical contact 22 to a signal system indicated generally at 25. A second electrical lead 26 extends from the second anchor 20 to the signal system 25 such that the leads 24, 26 and that portion of the wire 17A disposed between the electrical contact 22 and the second anchor 20 form an electrical circuit that, when closed, will activate signal system 25. Power to the circuit can be provided by means of a battery 28 shown disposed in the first electrical lead 24, or, alternatively power can be supplied from house current or other suitable means.

Signal system 25 includes a control means shown to be comprised as a solenoid 29 operably associated with a bell assembly 30 such that when the circuit is energized solenoid 29 is operable to close the switch of the bell assembly 30 circuit and activate the alarm thereof. Other forms of controls and alarms can be used.

The circuit that activates signal system 25 is normally open at electrical contact 22. Shown in FIGS. 2 and 3, electrical contact 22 is normally spaced from the wire 17 whereby the circuit is open.

Electrical contact 22 is comprised of a bolt having a slotted head 32 and an elongated shank 33 with a threaded end threaded into joist 11 to secure contact 22 with respect thereto and also to secure an end loop contact 24A of first lead 24. Shank 33 has a milled out or flattened portion 34 located above and in facing relationship to the wire 17. As shown in FIG. 3, a space 35 exists between the wire 17 and the flattened out portion 34. The space 35, or the distance between an electrical contact 22 and wire 17, can be varied by rotation of the shank 33 upon rotation of slotted head 32. This adjusts the sensitivity of the alarm by varying the amount of deflection necessary to bring the electrical contact 22 into contact with the wire 17 and energize the signal system 25. e sensitivity of the alarm by varying the amount of deflection necessary to bring the electrical contact 22 into contact with the wire 17 and energize the signal system 25.

In the use of the invention, the circuit formed between electrical contact 22, first lead 24, signal system 25, second lead 26, anchor 20 and intermediate wire section 17A is normally open between the electrical contact 22 and the wire 17 by virtue of the space 35 between them. When an intruder indicated at 37 in phantom in FIG. 1, happens upon floor 12 and in the vicinity of alarm switch 16, there is localized deflection of joist 11 indicated in phantom in FIG. 1. The deflection of joist 11 results in a corresponding downward movement of electrical contact 22. Wire 17 does not deflect downwardly. This brings the electrical contact 22 into contact with the wirof joist 11 indicated in phantom in FIG. 1. The deflection of joist 11 results in a corresponding downward movement of electrical contact 22. Wire 17 does not deflect downwardly. This brings the electrical contact 22 into contact with the wire 17 to close the circuit and energize the signal system.

Varying the space 35 between the electrical contact 22 and wire 17 permits calibration of the amount of force or weight above device 16 necessary to energize the signal system. If the space 35 is made very small, then only a small amount of weight upon the floor 12 in the vicinity of switch 16 will cause contact between electrical contact 22 and wire 17 to result in an alarm. If the space 35 is made larger, then more weight is required. For example, in a house environment, there may be certain pet animals at liberty to roam about. The space 35 between the wire 17 and electrical contact 22 can be calibrated such that the smaller weight of the animals will not trigger the alarm, whereas the heavier weight of an unwanted intruder will trigger the alarm.

Alarm system 10 is simple, inexpensive and easy to install. Yet it is effective in detecting the presence of unwanted intruders. Alternatively, alarm system 10 can be used to detect overload as in warehouse or the like. While the alarm circuit of alarm system 10 is shown to be one that closes upon deflection of joist 11 to close a circuit and energize an alarm system, it is apparent that alarm device 16 can be used in a system whereby joist 11 causes the opening of a circuit to trigger an alarm system. In such a fashion, several of the switches 16 can be located around the building at various places and wired together in a series such that opening of the switches at any one location will result in energizing an alarm circuit. As shown in FIG. 4, the electrical contact 22A can have a shank 33B with flattened portion 34B located beneath the wire 17B and normally in contact with it. Upon deflection of the joist 11B, the circuit is opened to trigger a relay or the like and energize an alarm circuit.

A second form of the invention is shown in FIGS. 5 and 6 where an alarm device or switch 39 is installed with respect to a stairway. Switch 39 includes a taut wire 40 connected at one end to a first anchor 41 fastened to a first vertical side stairway riser 42. Wire 40 is oriented generally horizontally and extends to a second anchor or hook 44 secured in the opposite side vertical stairway riser 45. A turnbuckle 46 is connected between the end of wire segment 40 and the second anchor 45 in order to adjust the tension on the wire segment 40.

An electrical contact 48 is fastened to a step 49 located above the wire 40 and in proximity to the wire 40. As shown in FIG. 6, electrical contact 48 has a bracket 50 with an upper horizontal ledge 51 fixed to the under surface of step 49 by suitable screws 52. Bracket 50 has a vertical connecting piece 53 connected at its upper end to the horizontal ledge 51 and at the lower end to a second lower horizontal ledge 54. A nut 56 is fixedly secured to the lower ledge 54 with a contact washer 57 of a first electrical lead 58 disposed between the nut 56 and the ledge 54. A bolt 60 has a shank 61 threaded through the nut 56 and through a suitable opening in the lower ledge 54 terminating above wire segment 40. Bolt 60 has a head 62 that can be readily manually turned to adjust the space 63 between wire segment 40 and the lower part of shank 61.

A second lead 65 extends from turnbuckle 46. The first lead 58 and second lead 65 can extend to alarm signal system of the type earlier described. Electrical contact 48, first lead 58, the segment of wire 40 located between electrical contact 48 and second anchor 44, and the second lead 65 all comprise portions of an electrical circuit which in conjunction with the signal system (not shown) comprises a circuit that when closed will provide an alarm signal. In use, bolt 60 is adjusted with respect to nut 56 such that the end of shank 61 is spaced slightly above lead wire 40. When a weight is imposed upon the step 49, it deflects and also deflects the electrical contact 48 downwardly. This is a localized deflection, and the wire segment 40 does not deflect. Therefore, the shank 61 of bolt 60 comes in contact with wire segment 40 and closes the alarm circuit to sound the alarm.

The sensitivity of the circuit can be adjusted by adjusting the amount of space 63 located between the wire 40 and the lower end of shank 61 of bolt 60. A greater amount of space that is provided will require a greater amount of weight or deflection to close the circuit and trigger the alarm. Thus the device can be calibrated or adjusted so that normal household pets or the like will not set off the alarm, yet the greater weight of the normal intruder will.

While there has been shown and described certain forms of the invention, it will be apparent to those skilled in the art that deviations can be had from those of the embodiments of the invention illustrated without departing from the scope and spirit of the invention.

The embodiments of the invention in which an exclusive property or privilege is claimed are defined as follows:

1. An alarm device installable with respect to a locally deflectable building structure member, comprising:

an electrical contact fixed for deflection with the deflectable member and movable upon deflection of the deflectable member between a first position and a second position deflected from the first position;

a taut wire having a portion located proximate the electrical contact;

first anchoring means fixed to the deflectable member anchoring one end of the wire to the deflectable member, and second anchoring means fixed to the deflectable member anchoring an opposite end of the wire to the deflectable member, said wire portion being located between the first and second anchoring means;

said electrical contact and wire being relatively located such that the electrical contact is in contact with said wire in one of said positions and out of contact with said wire in the other of said positions;

said electrical contact and wire when being in contact forming an electrical circuit for association with an alarm system.

2. The alarm device of claim 1 wherein: the taut wire is installed in substantially horizontal orientation between the first anchoring means and the second anchoring means.

3. The alarm device of claim 2 including: means for adjustment of the distance between the electrical contact and the wire when the electrical contact and the wire are in position out of contact.

4. An alarm device installable with respect to a locally deflectable building structure member, comprising:

an electrical contact fixed for deflection with the deflectable member and movable between a first position and a second position deflected from the first position;

a taut, generally horizontal wire having a portion located proximate the electrical contact;

said electrical contact and wire being relatively located such that the electrical contact is in contact with said wire in one of said positions and out of contact with said wire in the other of said positions;

said electrical contact comprised as an elongated member with a threaded end threaded into the deflectable member and with a flat portion in facing relationship to the said wire whereby rotation of the member moves edges of the flat portion toward and away from the wire to vary the distance between the electrical contact and the wire;

said electrical contact and wire when being in contact forming an electrical circuit for association with an alarm system.

5. The alarm device of claim 2 or 4 including: means to adjust the tension of the wire.

6. An alarm device for installation on an elongated floor support member of a building of the type locally deflectable upon imposition of weight upon the floor, comprising:

a length of taut electrically conductive wire;

first anchoring means secured to one end of the wire and secured to the floor support member;

second anchoring means connected to the other end of the wire and secured to the floor support member to position the wire in generally horizontal parallel relationship to the floor support member;

an electrical contact secured to the floor support member at a location intermediate the first and second anchoring means and proximate the wire and movable with the floor support member between an undeflected position and a deflected position;

said electrical contact and wire being located so that the electrical contact is in contact with said wire in one of said positions and out of contact with said wire in the other of said position;

said electrical contact and wire when being in contact forming an electrical circuit for association with an alarm system.

7. The alarm device of claim 6 including: a first lead connected to the electrical contact for extension to an alarm system and a second lead connected to the wire for connection to an alarm system.

8. The alarm system of claim 7 wherein: the electrical contact is located above the wire and downward deflection of the floor support member responsive to imposition of a predetermined load on the floor is operative to move the electrical contact downward into contact with the wire.

9. The alarm device of claim 8 wherein: the electrical contact is an elongated member with a threaded end threaded into the floor support member, and having a shank with a flattened portion in facing relationship to the wire, said flattened portion having edges such that rotation of the shank of the contact is operative to vary the distance between the contact and the wire to vary the amount of preselected loading on the floor necessary to move the electrical contact into contact with the wire.

10. The alarm device of claim 9 including: means to vary the tension in the wire.

11. The alarm device of claim 9 wherein: one of said anchoring devices is comprised as a screw type member having a threaded end threaded into a floor support member, the end of said wire being connected to the shank of the screw type member such that rotation of the screw type member into the floor support member is operative to wind the wire about the shank and increase the tension thereof.

12. The alarm device of claim 6 or 7 wherein: said electrical contact is located beneath the wire and in contact with the wire in the undeflected position wherein the force of a preselected loading on the floor is operative to deflect the floor support member and move the electrical contact out of contact with the wire.

13. The alarm device of claim 12 wherein: the electrical contact is an elongated member with a threaded end threaded into the floor support member, and having a shank with a flattened portion in facing relationship to the wire, said flattened portion having edges such that rotation of the shank of the contact is operative to vary the distance between the contact and the wire to vary the amount of preselected loading on the floor necessary to move the electrical contact into contact with the wire.

14. The alarm device of claim 13 wherein: one of said anchoring devices is comprised as a screw type member having a threaded end threaded into a floor support member, the end of said wire being connected to the shank of the screw type member such that rotation of the screw type member into the floor support member is operative to wind the wire about the shank and increase the tension thereof.

15. An alarm device for installation with respect to a set of stairs having steps locally deflectable upon imposition of the weight of a person on the upper surface thereof, said steps being separated by side vertical stair risers, said alarm device comprising:

a length of taut wire;

first anchoring means anchoring one end of the wire to a side vertical stair riser, a second anchoring means anchoring the opposite end of the wire to the opposite side vertical stair riser;

an electrical contact fastened to the under surface of a step located above the wire and being deflectable with the step on imposition of a weight on the step between an undeflected position and a deflected position;

said electrical contact and wire being so located that the electrical contact is in contact with said wire in one of said positions and out of contact with said wire in the other said positions;

said electrical contact and wire when being in contact forming an electrical circuit for association with an alarm system.

16. The alarm device of claim 15 including: means to adjust the tension of the wire.

17. The alarm device of claim 15 wherein: said electrical contact is positioned to be out of contact with said wire in the undeflected position and including means to vary the distance between the wire and the electrical contact in the undeflected position.

18. The alarm device of claim 17 wherein: said electrical contact includes a bracket with an upper horizontal ledge fixed to the lower surface of said step, a vertical connecting member connected to the upper horizontal ledge, and a lower horizontal ledge connected to the vertical connecting member, said lower horizontal ledge carrying threaded means, a bolt having a threaded shank threaded into the threaded means and movable toward and away from said wire upon being threaded into and out of the threaded means.

19. The alarm device of claim 18 including: a first lead extending from the electrical contact and connectable in an alarm circuit, and a second lead extending from the wire and connectable in an alarm circuit.

* * * * *